United States Patent [19]

Frudd

[11] 4,370,215

[45] Jan. 25, 1983

[54] RENEWABLE ELECTRODE ASSEMBLY

[75] Inventor: Francis D. Frudd, Fairport, N.Y.

[73] Assignee: The Dow Chemical Company, Midland, Mich.

[21] Appl. No.: 229,617

[22] Filed: Jan. 29, 1981

[51] Int. Cl.[3] ..... C25B 9/00; C25B 11/02; B23K 31/00; B23P 19/00

[52] U.S. Cl. ..... 204/242; 204/288; 204/289; 228/119; 228/191; 228/901; 29/825

[58] Field of Search ..... 204/286, 288, 289, 242; 29/825; 228/119, 191, 901

[56] References Cited

U.S. PATENT DOCUMENTS

| | | | |
|---|---|---|---|
| 1,303,519 | 5/1919 | Stuart | 204/289 X |
| 1,815,080 | 7/1931 | Smith | 204/288 X |
| 2,917,811 | 12/1959 | Powers | 29/25.18 |
| 3,719,578 | 3/1973 | Berthoux et al. | 204/286 X |
| 3,838,035 | 9/1974 | Pumpphery | 204/286 X |
| 3,857,774 | 12/1977 | Morton et al. | 204/242 |
| 3,912,616 | 10/1975 | Ford | 204/286 |
| 3,919,059 | 11/1975 | Raetzsch et al. | 204/129 |
| 3,954,593 | 5/1976 | Schmidt | 204/286 X |
| 4,013,525 | 3/1977 | Emsley | 204/286 X |
| 4,014,763 | 3/1977 | Lowe | 204/242 X |
| 4,039,403 | 8/1977 | Astley et al. | 204/287 X |
| 4,060,475 | 11/1977 | Fournier et al. | 204/286 X |
| 4,078,986 | 3/1978 | Smith | 204/286 X |
| 4,116,802 | 9/1978 | Smith | 204/288 X |
| 4,244,802 | 1/1981 | Pohto et al. | 204/288 X |
| 4,260,470 | 4/1981 | Fisher | 204/286 |

FOREIGN PATENT DOCUMENTS

| | | |
|---|---|---|
| 1125493 | 8/1968 | United Kingdom . |
| 1127484 | 9/1968 | United Kingdom . |

*Primary Examiner*—Donald R. Valentine
*Attorney, Agent, or Firm*—Charles J. Enright

[57] ABSTRACT

An electrode assembly comprising an electroconductive support, an electrode body, and a flange extending from the body with a plurality of tabs. The flange is attached to the electroconductive support by fastening some but not all of the tabs to the support. This permits removal of the electrode by separating the electrode body from the tabs attached to the support. The electrode is reinstalled by fastening at least one of the remaining tabs to the support.

12 Claims, 8 Drawing Figures

RENEWABLE ELECTRODE ASSEMBLY

BACKGROUND OF THE INVENTION

This invention relates to electrode assemblies for electrolytic cells and in preferred embodiments to anode assemblies in electrolytic cells used for the production of chlorine, chlorates, hypochlorites and alkali metal hydroxides.

DESCRIPTION OF THE PRIOR ART

The desirability of being able to replace electrodes in electrolytic cells has been known for a long time. For example, in U.S. Pat. No. 1,053,266, cylindrical carbon anodes were threaded at one end to allow them to be mechanically and electrically connected to a conductive support by screwing them into matingly threaded holes in the support. More recently, we have seen the advent of so-called dimensionally stable anodes; which may comprise an electrode of a film-forming metal such as titanium, with an electroconductive coating such as a platinum group metal or oxide. It is desirable to remove and replace the electrodes so that the coatings thereon may be renewed.

British Pat. Nos. 1,27,484 and 1,125,493 and U.S. Pat. No. 3,954,593 describe flat, planar, anodes which are bolted to raised flange-like members extending from the electroconductive support. These require complex fabrication techniques to form the flange-like extensions on the electroconductive support, while preventing fluid leaking through the support.

U.S. Pat. Nos. 3,919,059 and 4,060,475 describe planar electrodes with a perpendicular flange on one edge which is bolted to the electroconductive support. The bolts and nuts utilized are generally made from the same film-forming metal as the electrode. These components are rather expensive and in a commercial size unit represent a significant capital investment. An extra fabrication step is required to attach the bolt on which the electrode is to be mounted to the electroconductive support.

U.S. Pat. Nos. 1,303,519; 4,078,986; and 3,919,059 describe planar anodes which have a perpendicular flange along one edge which is welded to an electroconductive support. In the '519 patent, the electroconductive support is a plate which is then bolted into the electrolytic cell. The electrode of the '986 patent is welded to a conductive strip which is in turn welded to a metal base plate. Alternatively, the electrodes may be welded directly to the surface of the metal base plate. The electrode is removed by cutting the base of the anode free from the support rib. Removal of the electrode, if it is welded directly to the metal base plate, must be conducted with extreme caution lest the base plate itself be damaged. The electrode of the '059 patent is also welded to the electroconductive support. No means for removing or replacing the electrode are described.

An object of this invention is to provide an electrode which can be easily installed with a minimum capital investment, and yet which can be easily removed and reinstalled.

SUMMARY OF THE INVENTION

The advantages of the invention are realized by using a renewable electrode assembly comprising a support, an electrode body, and a flange extending from the body which has a plurality of tabs. Some, but not all, of the tabs are fastened to the support and can be separated from the body.

In a preferred embodiment, the flange tabs are substantially perpendicular to the plane of a planar electrode body and are attached to the support by spot welding.

The electrode of the invention is installed onto a support by fastening at least one but not all of the tabs to the support.

A particularly favorable aspect of the invention is that the electrode can be easily removed for renewal or repair and then reinstalled on the support. This allows the electrode to be renewed at a place remote from the supporting member and cell in which it is normally installed.

The electrode of the invention is preferably removed by cold working to separate the electrode body from the tabs fastened to the support. The electrode can then be renewed by methods known to the art. The electrode is then reinstalled by fastening at least one of the remaining tabs to the support. The preferred method of cold working comprises bending or rotating the joint between the electrode body and the flange.

BRIEF DESCRIPTION OF THE DRAWING FIGURES

The accompanying figures, in which like numbers within the several figures represent like parts, further illustrate the invention.

Figure 3:
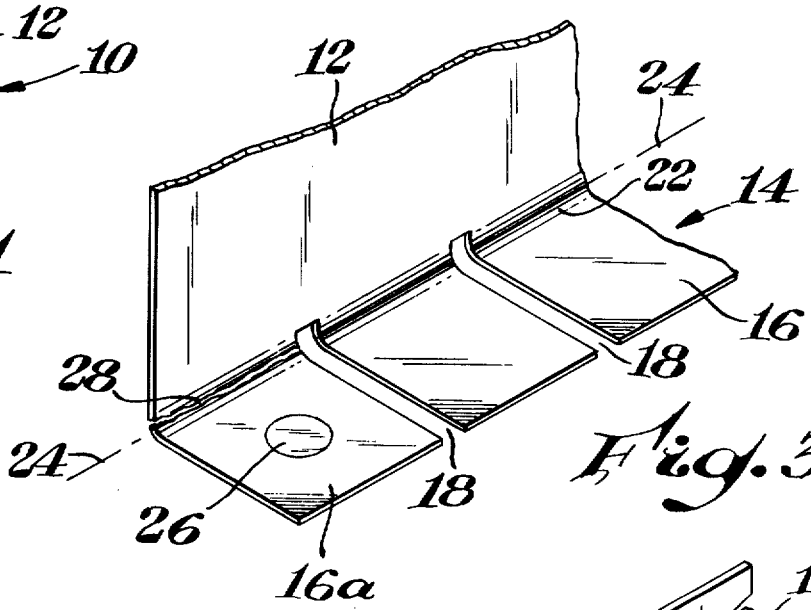

FIG. 3, also a partial detail, shows a preferred configuration of the flange tabs of the electrode.

Figure 4:
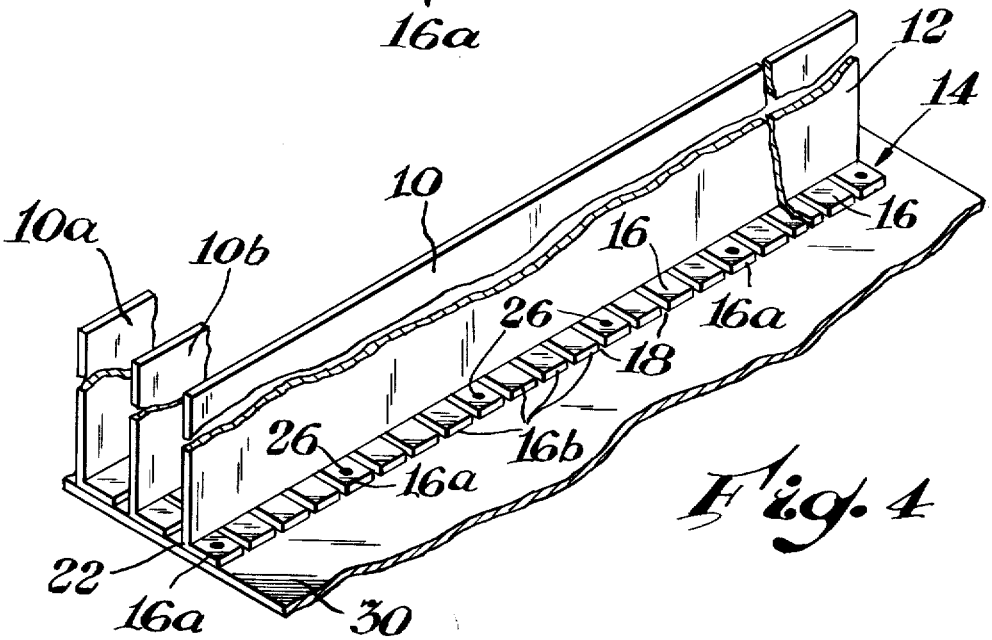

FIG. 4 shows an electrode of the invention fastened to an electroconductive support.

FIGS. 5, 5A, 6 and 7 show differing views of a tool being used to remove electrodes of the invention from an electroconductive support.

DETAILED DESCRIPTION OF SPECIFIC EMBODIMENTS

Electrolytic cells in which the electrode of the invention can be used include those in which there is a need for removal and replacement of an electrode attached to a more or less permanent part of the electrolytic cell. Beneficial use for the electrode of the invention can be made, for example, in electrolytic cells for the production of chlorine, chlorates, hypochlorites and alkali metal hydroxides. These are generated by the electrolysis of aqueous solutions of alkali metal salts. Such electrolytic cells are well-known and described in the literature.

The electrode of the invention can be used in diaphragm cells similar to those described in British Pat. No. 1,125,493 or U.S. Pat. No. 3,975,255, which are herein incorporated by reference.

The electrode of the invention may also be used in bipolar cells similar to those described in U.S. Pat. Nos. 3,919,059 and 4,032,423 which are herein incorporated by reference.

The electrode of the invention may also be incorporated in electrolytic cells which lack a diaphragm such as the cell described in U.S. Pat. No. 4,060,475 which is used to make alkali metal chlorates, and is herein incorporated by reference.

The electrode of the invention is generally composed of metal or a metal alloy. In a preferred embodiment, the electrode will be what is termed a dimensionally stable anode, that is, made from a film-forming metal. The film-forming metals include tantalum, tungsten, zirconium, niobium and titanium. The metal most preferred and the most widely used commercially is titanium. Alloys of such film-forming metals can be employed as long as the alloy does not have a substantially lower resistance to corrosion than the film-forming metals in the environment of the cell in which it is used.

In order to effectively carry out the electrolytic process in the cell, these electrodes of the film-forming metals are generally coated with a catalytically active material. Such catalytically active materials include the platinum group metals as described in U.S. Pat. Nos. 3,632,498 and 3,711,385 to Beer. Preferred coatings and methods of coating are described in U.S. Pat. Nos. 3,975,557; 3,977,958; 4,061,549; 4,112,140 and 4,142,005 which are herein incorporated by reference. These coatings are removed during use. Accordingly, it is desirable to be able to remove the electrode from the cell, to recoat it, and to replace it in the cell with a minimum of difficulty.

Figure 1:
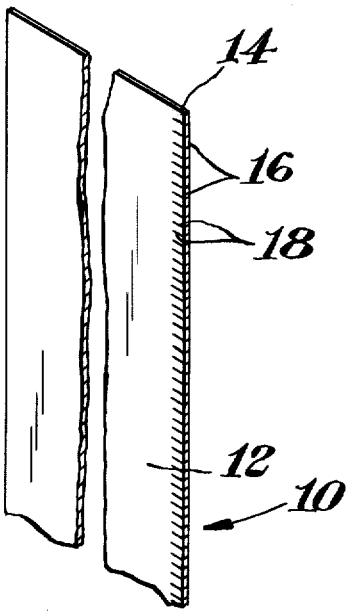
FIG. 1 represents an embodiment of the electrode of the invention in which fabrication of the electrode is partially completed.
Figure 2:
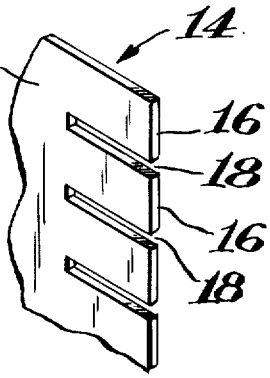
FIG. 2 shows a view of part of the electrode of the invention showing tabs and slots.

FIGS. 1 and 2 show a generally planar electrode 10 comprising an electrode body 12 and electrode flange 14 preferably along one edge. The flange includes flange tabs 16 with mediate flange slots 18. FIGS. 3 and 4 show a more preferred embodiment where the electrode flange 14 and the electroconductive support 30 to which the electrode is attached are substantially perpendicular to the electrode body 12. The flange 14 extends at right angles to the electrode body along the axis 24 of the joint 22 between the flange and the body. The slots 18 preferably extend through the joint 22 so that, as the joint is cold worked, the tabs attached to the electroconductive support break, and the body may be removed from the electroconductive support 30. For purposes of illustration, tab **16*a* is attached to an electroconductive support (not shown) by a weld 26. A break 28 is shown between the electrode body and the flange tab 16*a*. Thus, since the other tabs are not attached to the electroconductive support, the body of the electrode can be separated from tab 16*a*** and the electroconductive support while remaining attached to the remaining tabs.

FIG. 4 shows the general configuration that the electrodes of the invention may take when placed in an electrolytic cell. Electrolytic cells generally will contain a plurality of electrodes 10, **10*a* and 10*b* which are fastened to the electroconductive support 30 at the flange 14 by welds 26 on the tabs 16*a***.

In the normal configuration for a diaphragm cell, diaphragms (not shown) would extend in between the electrodes 10 and **10*b*; and 10*b* and 10*a*. In diaphragmless cells, cathodes similarly would extend into the space between the anodes. In bipolar cells, cathodes (not shown) are attached electroconductively to the opposite side of the electroconductive support 30**.

The method for installing the electrode of the invention comprises fastening at least one but not all of the tabs to the support. The fastening may be done by welding, soldering, braising, riveting, stapling, screwing, bolting or bonding with an electroconductive adhesive to the support. Combinations of these or other forms of fastening known to those in the art may be used.

The preferred method of fastening the tabs to the support is by welding, for example, using inert-gas-shielded metal arc, tungsten-arc, inert-gas, electric resistance, spot, seam, flash or pressure welding. Welding methods for titanium are well-known in the art and are exemplified at pages 509–513 of *The Welding of Non-ferrous Metals*, E. G. West, John Wiley & Sons, Inc., New York (1951), which is incorporated herein by reference.

A key aspect of the invention is that some, but not all of the tabs are fastened to the support. In the specific embodiment shown in FIG. 4, one in four of the tabs are fastened to the support. Enough of the tabs should be fastened to the support to provide the necessary electroconductivity from the support to the functional portion of the electrode.

The electrodes of the invention are fastened to the support strongly enough mechanically so that they will not come off during normal use. Generally, this means that the fastening for a given electrode only need be mechanically strong enough to support the weight of the electrode. Generally, a bond strong enough to provide the necessary electroconductivity will also have the mechanical strength required.

Generally, the electrode of the invention is fastened to an internal portion of the electrolytic cell. This internal portion may take many forms known to those skilled in the art. For example, the support may take the form of a perforate sheet as is exemplified in U.S. Pat. No. 4,013,525; or the form of a flange or fin as shown in U.S. Pat. No. 3,954,593 or British Pat. No. 1,127,484. The electrode may be fastened to the side of a longitudinally extending strip such as in U.S. Pat. Nos. 4,080,279 or 4,116,802 or to the face of a longitudinal strip, for example as in U.S. Pat. Nos. 3,919,059 or 4,078,986. In a preferred embodiment, the electrode body is planar and the flange, tabs and the support are substantially perpendicular to the plane of the electrode body, and the electrode tabs are fastened directly to the perpendicular support. Examples wherein this configuration has utility may be seen in U.S. Pat. No. 4,060,475 and in FIG. 3 of U.S. Pat. No. 3,919,059.

A particularly significant advantage of the electrode assembly of the invention is that it may be easily removed from the support, worked upon, and then reinstalled on the support. In this method of the invention, the electrode of the invention is removed by separating the electrode body from the tabs fastened to the support. The electrode is then repaired or renewed as, for example, by removing an old catalytic coating and replacing it with a fresh coating. The electrode is then reinstalled by fastening at least one of the remaining tabs to the support. The preferred method of separation is by cold working. The methods of cold working that may be used include chiseling, cutting, breaking, snipping, chopping, sawing, tearing or other known means. A preferred method of cold working the electrode of the invention, shown in FIG. 5A, is by bending or rotating the body about the axis 24. This fatigues the metal of the electrode and causes the joint 28 between the tab **16*a* and the body of the electrode 12** to break.

It is a desirable aspect of the invention that while the electrode is being removed from the tabs fastened to the support that the support itself not be distorted or damaged. It is further desirable in the preferred electrolytic cell wherein the support is a flat sheet at right angles to the electrode body, that it not be necessary that the electrode support be massive in order to avoid such distortion or damage. In a preferred embodiment for removing the electrode, the body of the electrode is rotated about the axis 24 by a tool 42 shown in FIGS. 5–7. In preferred embodiments, the flange 14 is substantially planar and is attached to a single face of the support, so that rotating the body 12 about the axis 24 is facilitated.

The likelihood of contact either purposeful or accidental of the tool with the support is substantially reduced by the use of the tool shown generally at 42. The removal tool 42 generally comprises at least one handle and generally two handles 44 for manipulation by the operator. The handle attaches to a part of the tool adapted to grip the body of the electrode 12. This gripping portion comprises an angle iron 46 attached to the handles 44. The lower portion of the angle iron, proximal to the electrode support during use is angled away from the electrode support at 58 to allow maximum angular rotation away from the electrode's original position.

A second portion of the lower portion of the tool 42 is the U-channel 50 which is separated from the angle iron 46 by a gap 48. The gap is maintained by a shims 52 which permit the positioning of the electrode body in between the angle iron and the U-channel. The shim also minimizes bowing of the U-channel 50 during rotation of the tool 42. The result is a more uniform grip across the base of the electrode. The gap is not critical but should be of such a width that the angle iron and U-channel snugly grip the body of the electrode, but should permit enough play that the tool may be fitted over slightly damaged electrodes. The U-channel 50 is attached to the angle iron 46 by studs 54 which are welded to the angle iron 46. The nuts 56 are screwed onto the studs 54 to firmly attach the two pieces.

Figure 5:
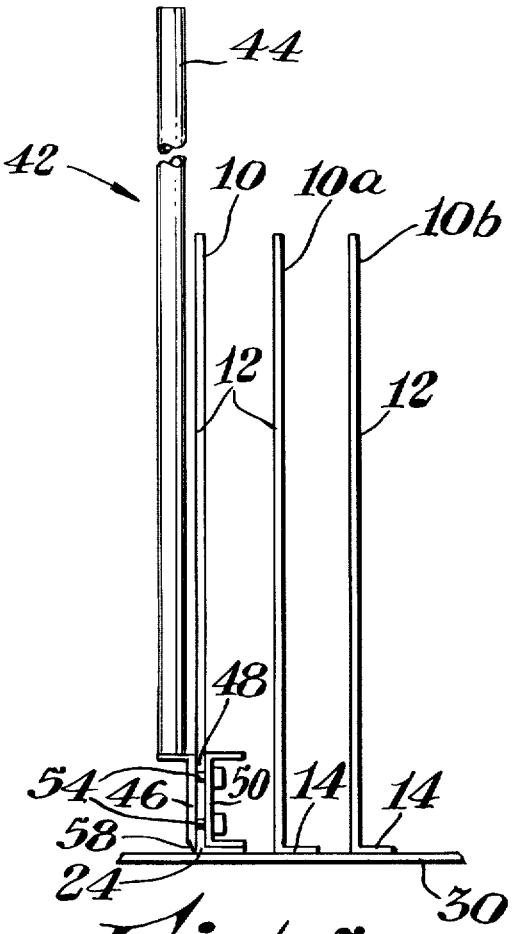
Figure 7:
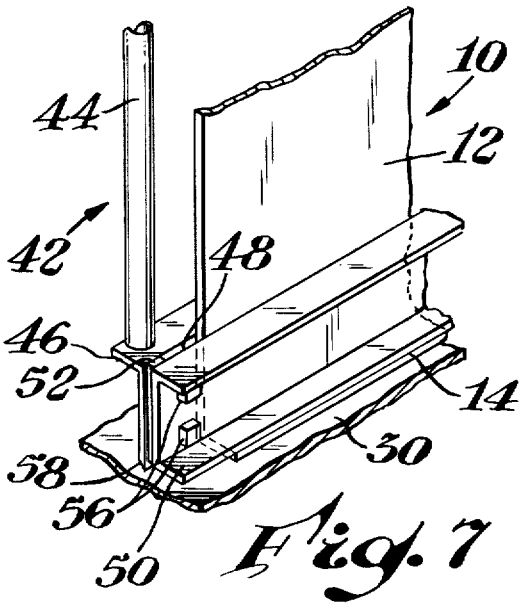
Figure 5A:
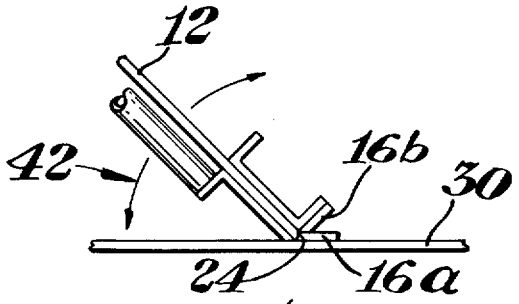
Figure 6:
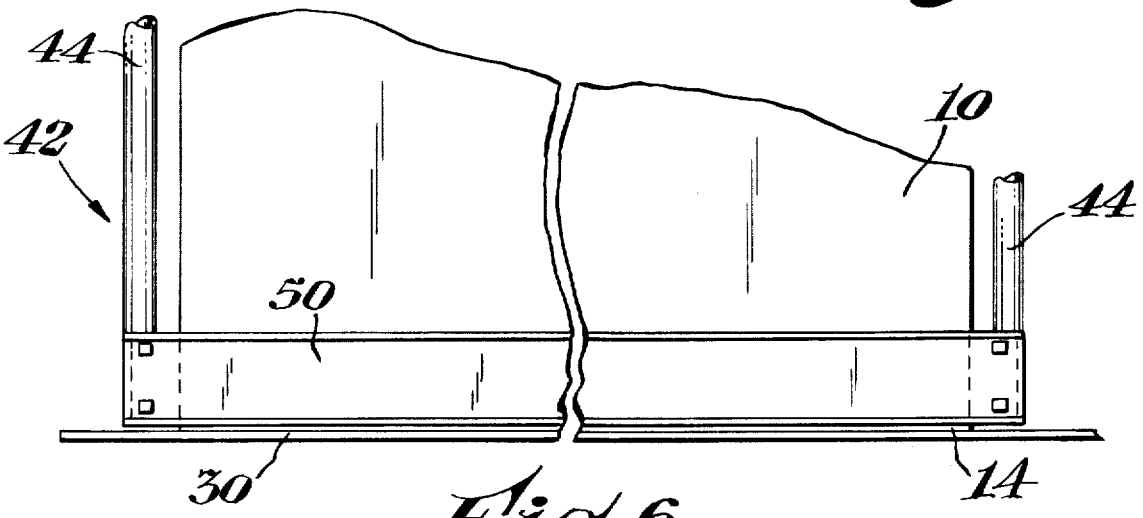

When removing a series of electrodes as shown in FIG. 5, it is necessary to start at the end of the support opposite in direction to the extension of the flanges 14 fastened to the support.

Once having gained purchase on the electrode body, the tool is rotated as shown by the arrows in FIGS. 5 and 5*a* in first a counterclockwise then a clockwise direction. This movement rotates the electrode body 12 about the axis 24 of the joint 22 between the body and the flange 14. This movement also bends the joint 22 but only between the tabs 16*a* which are attached to the support 30 and the body 12 of the electrode. This movement does not bend the joint between the tabs 16*b* because there is nothing to hold them against the support and they will rotate up with the body of the electrode. After a number of times rotating the tool back and forth, the joint 22 will experience metal fatigue between the fastened tab 16*a* and the body 12 and ultimately break. At this point the body of the electrode 12 is no longer fastened to the electrode support 30.

After renewal, this same electrode may be reattached to the same point on the electrode support by fastening at least one of the remaining tabs 16*b* to the electrode support 30. The tabs 16*b* are those that were not fastened during a prior installation of the electrode. The means for refastening can be one or more of those described above for installing the electrode of the invention except that after having been removed one or more times, all of the tabs remaining may have to be fastened to the electrode support to get adequate strength and electrical conductivity.

While several embodiments have been shown and described in accordance with the present invention, it is obvious that the same is not limited thereto but is susceptible to numerous changes and modifications as known to those skilled in the art, and therefore the invention is not limited to the details shown and described herein but covers all such changes and modifications as are encompassed by the scope of the appended claims.

What is claimed is:

1. A renewable electrode assembly comprising:
(1) a support;
(2) an electrode body; and
(3) a flange extending from one edge of the electrode body and fastened to the support; said flange having a plurality of tabs, at least one of said tabs being fastened to the support and separable from the electrode body; and at least one tab not being fastened to said support.

2. The electrode assembly of claim 1 wherein the electrode body is substantially planar.

3. The electrode assembly of claim 2 wherein the flange and tabs and the support are substantially perpendicular to the plane of the electrode body.

4. The electrode assembly of claim 1 or 3 wherein the electrode assembly forms part of an electrolytic cell and the electrode body forms an anode extending into an electrolyte.

5. A method for installing an electrode onto a support;
said electrode comprising:
(a) an electrode body; and
(b) a flange extending from one edge of the body, said flange having at least two tabs separable from the electrode body;
said method comprising: fastening at least one but not all of said tabs to the support.

6. The method of claim 5 wherein the electrode body is substantially planar.

7. The method of claim 6 wherein the flange, the tabs, and the support are substantially perpendicular to the plane of the electrode body.

8. The method of claim 5 wherein the fastening step comprises welding.

9. A method for removing and reinstalling an electrode on a support;
said electrode comprising:
an electrode body; and a flange extending from one edge of the body and fastened to the support; said flange having a plurality of tabs, at least one of said tabs being fastened to the support and separable from the electrode body; and at least one tab not being fastened to said support; said method comprising:
(1) removing the electrode by separating the electrode body from the tabs fastened to the support; and
(2) reinstalling the electrode by fastening at least one remaining tab to the support.

10. The method of claim 9 wherein the electrode body is substantially planar.

11. The method of claim 10 wherein the flange, the tabs, and the support to which the electrode is attached are substantially perpendicular to the electrode body.

12. The method of claim 9 wherein said electrode is renewed or repaired before it is reinstalled.

* * * * *